US010053949B2

(12) United States Patent
Frazier

(10) Patent No.: US 10,053,949 B2
(45) Date of Patent: Aug. 21, 2018

(54) CEMENT RETAINER AND SQUEEZE TECHNIQUE

(75) Inventor: W. Lynn Frazier, Corpus Christi, TX (US)

(73) Assignee: MAGNUM OIL TOOLS INTERNATIONAL LTD, Corpus Christi, TX (US)

( * ) Notice: Subject to any disclaimer, the term of this patent is extended or adjusted under 35 U.S.C. 154(b) by 1045 days.

(21) Appl. No.: 13/385,936

(22) Filed: Mar. 15, 2012

(65) Prior Publication Data

US 2013/0240207 A1 Sep. 19, 2013

(51) Int. Cl.
*E21B 33/13* (2006.01)
*E21B 33/134* (2006.01)

(52) U.S. Cl.
CPC ..... *E21B 33/13* (2013.01); *E21B 33/134* (2013.01)

(58) Field of Classification Search
CPC ..... E21B 33/1204; E21B 33/1291; E21B 33/128; E21B 33/14; E21B 33/13; E21B 33/134
See application file for complete search history.

(56) References Cited

U.S. PATENT DOCUMENTS 2,196,661 A 4/1940 Grubb
3,283,820 A * 11/1966 Tausch ..... E21B 23/06 166/120
3,379,257 A * 4/1968 Tamplen ..... 166/137
3,454,090 A * 7/1969 Brown ..... E21B 41/00 166/138
3,713,486 A 1/1973 Meitzen
3,921,720 A 11/1975 Wetzel
4,133,386 A 1/1979 Knox
4,378,838 A * 4/1983 Ogden ..... E21B 33/16 166/153
5,246,069 A * 9/1993 Glaser ..... E21B 17/14 166/153
7,409,990 B1 8/2008 Burts
7,428,927 B2 9/2008 Vert
7,600,572 B2 10/2009 Slup
7,861,781 B2 1/2011 D'Arcy
2002/0104656 A1* 8/2002 Murley et al. ..... 166/291
(Continued)

OTHER PUBLICATIONS

Weatherford, Liner Hanger Selection, pp. 1-22, especially pp. 14-15.

(Continued)

*Primary Examiner* — Nicole Coy
*Assistant Examiner* — Kristyn A Hall
(74) *Attorney, Agent, or Firm* — G. Turner Moller

(57) ABSTRACT

A cement retainer comprises a plug that may be run into casing on a wire line and set in a conventional manner. A passage through the plug allows cement to be pumped therethrough. A wiper plug follows the cement, wipes the inside of the casing and latches onto the retainer to prevent back flow of cement. In some embodiments, the cement retainer and wiper plug are made of drillable materials allowing a series of squeeze operations to be conducted, one after another without undue delay, and then be drilled up in a single bit run. In some embodiments, the cement retainer and wiper plug are made of metals, drillable or non-drillable, or other long lived materials in order to plug wells in the process of abandoning them.

18 Claims, 3 Drawing Sheets

(56) References Cited

U.S. PATENT DOCUMENTS

| | | | | |
|---|---|---|---|---|
| 2002/0162657 | A1 | 11/2002 | Tumlin | |
| 2006/0272818 | A1* | 12/2006 | Adam et al. | 166/285 |
| 2010/0147517 | A1* | 6/2010 | D'Arcy | E21B 33/16 166/291 |
| 2010/0155050 | A1 | 6/2010 | Frazier | |
| 2010/0193190 | A1 | 8/2010 | Blount | |
| 2011/0162644 | A1 | 7/2011 | Mauth | |

OTHER PUBLICATIONS

Weatherford—Casing Wiper Plugs and Darts, pp. 1-58; Applicant is not sure all of the elements in this publication are prior art as to this application but the darts on pp. 51+ are prior art.

* cited by examiner

CEMENT RETAINER AND SQUEEZE TECHNIQUE

This invention relates to a cement retainer and technique to squeeze perforations in a hydrocarbon well.

BACKGROUND OF THE INVENTION

Cement is used in almost all hydrocarbon wells to isolate a section of a pipe string or well bore. The most common cementing operation is to cement a pipe string or casing in a well bore to secure the pipe string and seal off the contents of formations penetrated by the well bore. This is often called primary cementing and involves pumping cement into the casing and then pumping a wiper plug down the casing so it pushes the cement out of the bottom of the casing through a float shoe or collar into which the wiper plug latches. The cement travels upwardly through the annulus between the casing and the well bore and ultimately sets up to secure the casing in the well bore and seal off the formations penetrated by the well bore.

Another common cementing operation occurs when it is necessary or desirable to place cement between casing and the well bore at one or more locations above the bottom of the casing. This almost always occurs at locations that cannot be predicted in advance so the casing is not normally equipped with collars, slots or profiles in which squeeze equipment can be latched. Thus, squeeze operations are normally conducted through perforations in the casing. Often, the perforations open into a hydrocarbon bearing formation and it is desirable to squeeze cement through the perforations to isolate the formation. Squeeze operations are also conducted to repair a poor primary cement job by squeezing cement into areas where cement is poor or non-existent. Conventionally, a cement retainer is run on the bottom of a work string and comprises slips to set the retainer against the casing, a seal to seal between the casing and the cement retainer and an actuable valve that can be opened by manipulation of the work string to allow cement to be pumped through the cement retainer and through the perforations. After a desired amount of cement is pumped through the cement retainer, an amount of water or completion fluid is pumped into the work string to displace cement in the work string and cement retainer. After the cement sets up, the cement retainer and work string are pulled from the casing. Naming this tool a cement retainer is quite descriptive because its function is to retain cement behind the casing and prevent it from flowing back into the inside of the casing.

In some areas, it is very difficult to get good cement jobs on surface pipe or intermediate casing at shallow depths. This almost surely has something to do with the unconsolidated nature of shallow formations. Whatever the reason, it often occurs that long stretches of casing are poorly cemented, meaning that many squeeze jobs are necessary to provide adequate cement between the casing and the well bore. This is a slow operation because the cement must be allowed sufficient time to set up before pulling the cement retainer and work string, shooting a new set of perforations, running a new or redressed cement retainer back into the well on the work string to a location above the new perforations before pumping cement through the new set of perforations. Typically, only one squeeze job can be conducted in a 3-5 hour period at 4000'. The time to conduct a conventional squeeze operation is a function of depth because of the time to run a work string into the well and to retrieve it.

Disclosures of interest are found in U.S. Pat. Nos. 2,196,661; 3,921,720; 3,713,486; 4,133,386; 7,428,927 and 7,861,781 and Printed U.S. Patent Applications 20100193190 and 20110162844.

SUMMARY OF THE INVENTION

A novel cement retainer and novel squeeze technique are disclosed below. Although the cement retainer and wiper plug may be specially designed for the purpose, it is convenient and desirable that the cement retainer and wiper plug be time tested reliable equipment thereby avoiding the problems of newly designed equipment. To this end, the cement retainer may comprise a more-or-less conventional ball drop plug assembly or comparable device having a passage therethrough and a more-or-less conventional wiper plug or dart. The ball drop assembly, which now functions as a cement retainer, may be run into casing on wire line and set by a conventional setting tool at a location above perforations. Cement may be pumped into the casing and followed by the wiper plug or dart, which is followed by water or completion fluid, so the wiper plug latches onto the cement retainer and prevents the back flow of cement into the casing string.

In some situations, the cement retainer is made of readily drillable materials. In these circumstances, a squeeze job can be run immediately following a prior squeeze job without waiting for any cement to set up or suffering the delay of pulling a work string in order to start anew. In other words, immediately upon completion of a first squeeze job, a second set of perforations would be opened by a wire line perforating gun, a second cement retainer run on a wire line and set above the new perforations and a second batch of cement pumped into the well. These wire line operations are considerably quicker than waiting on cement to set and pulling a work string from the well. After all of the desired squeeze jobs have been done, all of the cement retainers and any cement remaining inside the casing can be drilled up in one bit trip. Thus, depending on the depth involved, squeeze jobs as disclosed may be conducted several times quicker than conventional squeeze jobs. Given a cost of $50,000/day for a land rig or $250,000/day for a large offshore rig, time is obviously money.

One object of this invention is to provide an improved cement retainer.

Another object of this invention is to provide an improved technique for squeezing perforations.

It is an object of this invention to provide an improved technique for conducting multiple squeeze jobs in an expeditious manner.

These and other objects and advantages of this invention will become more apparent as this description proceeds, reference being made to the accompanying drawings and appended claims.

DETAILED DESCRIPTION

The present invention relates to cement retainers for use in hydrocarbon wells drilled into the earth to squeeze a material known in the field as cement through perforations in a well casing. The materials from which the tools are made are subject to considerable variation. Some of the components can be of drillable metal and some can be of composite material. A composite material can be a fabric core impregnated with a resin which is hardened in some suitable manner. Any components left in the well are usually made of drillable materials. Various changes and adaptations can be made in the tools without departing from the spirit and scope of the invention, which is to be measured solely by the claims themselves.

Figure 1:
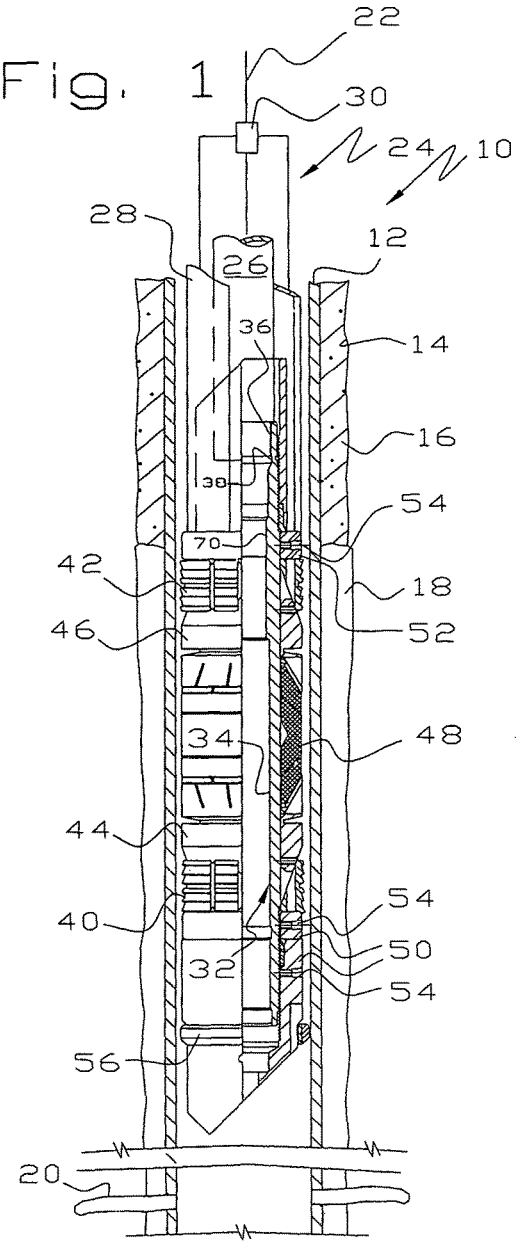
FIG. 1 is view, partly in cross-section, illustrating a cement retainer being run in casing in preparation for a squeeze job.
Figure 2:
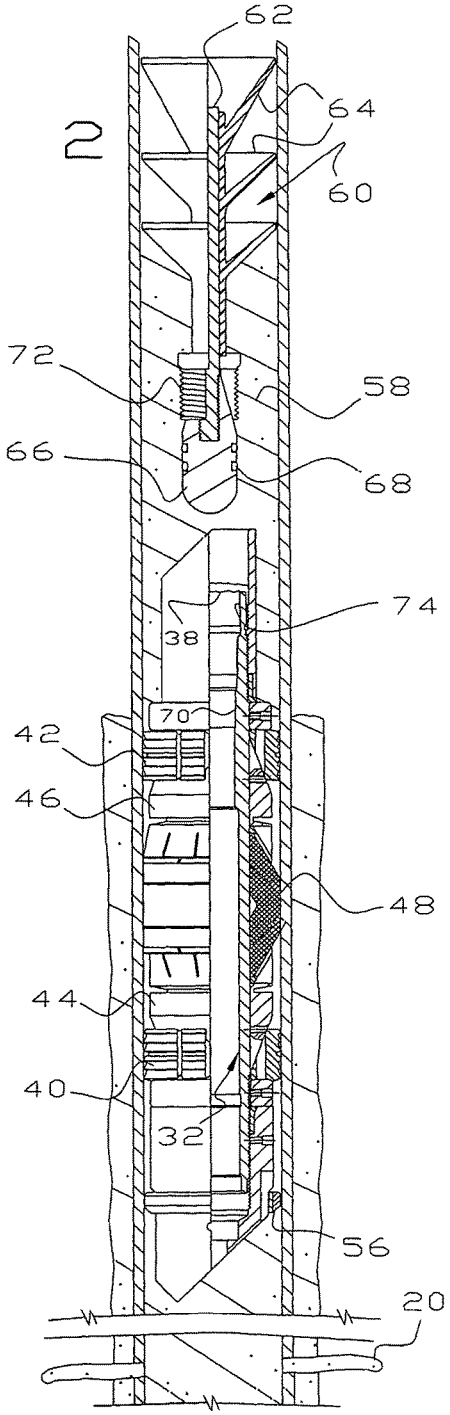
FIG. 2 is a view similar to FIG. 1, illustrating that the cement retainer has been set against the casing and cement is being pumped into the casing followed by a wiper plug or dart.
Figure 3:
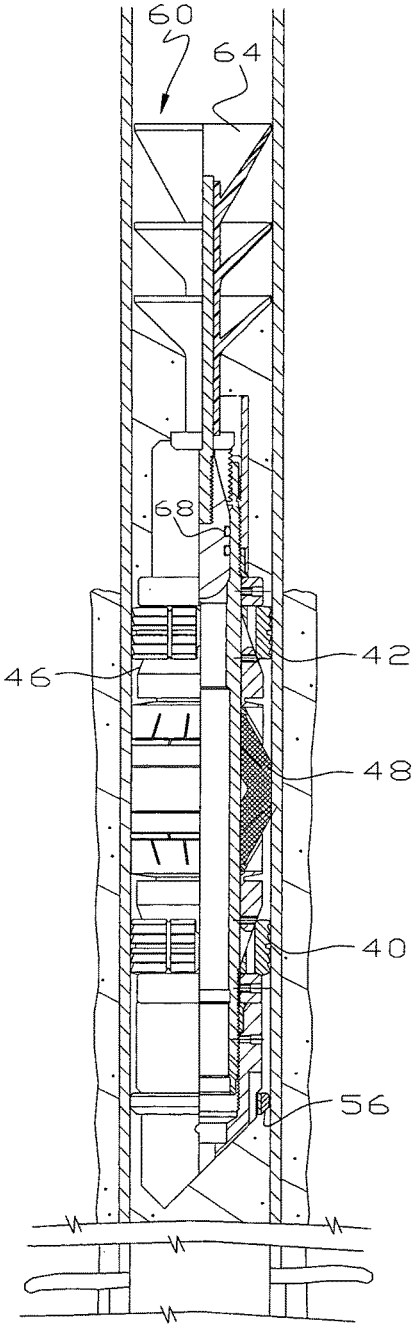
FIG. 3 is a view similar to FIG. 2, illustrating the wiper plug latched into the cement retainer at the end of a squeeze job.

Referring to FIGS. 1-2, there is illustrated a cement retainer 10 being run into a hydrocarbon well inside casing 12 which has been cemented in a well bore 14 by a cement sheath 16. The cement sheath 16 is illustrated as being discontinuous by the presence of gas or liquid pockets 18 which represents an area where there is little or no cement between the casing 12 and the well bore 14. Routine running of so-called bond logs conventionally detects areas of poor or nonexistent cement as is well know in the art.

When the primary cement job needs to be improved, perforations 20 may be shot through or adjacent the area 18 above the bottom of the casing 12. In any event, the cement retainer 10 may be run into the casing 12 on a wire line 22 attached to a setting tool 24. Current setting tools are available from Baker Hughes, Inc. or Owens Oil Tools, Inc. and are well known in the art. The setting tool 24 may accordingly comprise a tube or member 26 connected to a component of the cement retainer 10, a sleeve 28 resting on a shoulder of the cement retainer 10 and an actuating assembly 30 which pulls up on the tube 26 and pushes down on the sleeve 28. This causes the cement retainer 10 to be set against the casing 12 in a conventional manner and shears off the component attaching the setting tool 24 to the cement retainer 10, all in a conventional manner. The setting tool 24 may then pulled from the casing 12 by the wire line 22.

The cement retainer 10 may be of many different types and is illustrated as a top actuated ball drop plug commercially available from Magnum Oil Tools International, LLC of Corpus Christi, Tex. The cement retainer 10 may accordingly comprise a body or mandrel 32 having a passage 34 therethrough allowing flow from an upper end of the retainer 10 toward the lower end. The mandrel 32 may also include a threaded upper end 36 connected to a main section of the mandrel 32 by a necked down portion 38 which provides a shearable or detachable end of the mandrel 32. When the setting tool 24 pulls on the tube 26 and sets the cement retainer 10 in the casing 12, the necked down portion 38 pulls in two thereby separating the setting tool 24 from the cement retainer 10 so the setting tool 24 may be pulled from the well.

Mounted on the outside of the mandrel 32 are one or more sets of slips 40, 42, conical expanders 44, 46 and a flexible or malleable seal assembly 48. One or more retaining rings 50, 52 are pinned to the mandrel 32 by pins 54. When the setting tool 24 applies sufficient force to the tube 26 and sleeve 28, one or more of the pins 54 shear off thereby releasing the slips 40, 42 so they slide over the conical expanders 44, 46 and accordingly move toward each other and toward an interior of the casing 12. This compresses or manipulates the seal assembly 48 so it expands into engagement with the interior of the casing 12. The force generated by the actuator assembly 30 is surprisingly large. Conventional actuator assemblies 30 generate in the range of 100,000 pounds of force and conventional expandable well tools are actuated, typically, in the low to middle tens of thousands of pounds of force. In any event, operating the setting tool 24 expands the slips 40, 42 and the seal assembly 48 into engagement with the casing 12 as shown in FIG. 2, as may be done in a more-or-less conventional manner.

The cement retainer 10 may be used in a vertical well, relying on the weight of the retainer 10 to cause it to fall into the well and the wire line 22 to control its position. In the alternative, the retainer 10 may be used in a horizontal leg of a well using an exterior seal 56 so the retainer 10 can be pumped into the horizontal well and its position controlled by the wire line 22.

After the setting tool 24 is removed from the casing 12 by the wire line 22, a batch of cement 58 is pumped into the casing 12 followed by a wiper plug 60 with water or a completion fluid following the wiper plug 60. The wiper plug 60 may be of conventional design and is illustrated as a dart. Cementing darts are used in primary cementing operations and are available from a number of companies including Weatherford, Inc. The wiper plug 60 is illustrated as including a stem 62 having a series of wipers 64 which engage the interior of the casing 12 during movement into the casing 12 so the cement 58 is pushed ahead of the wiper plug 60 while water or a completion fluid pushes on the wiper plug 60. A nose 66 attaches to the stem 62 and includes one or more seals 68, such as O-rings or the like, which engage a sealing surface 70 provided by the mandrel 32. A male latch 72 on the wiper plug 60 meshes with and latches into a female latch 74 provided by the mandrel 32 near the necked down portion 38. The female latch 74 may comprise threads on the interior of the mandrel 32 to which the male latch 72 attaches, all in a conventional manner.

When the wiper plug 60 reaches the cement retainer 10, a lower portion of the stem 62 enters the passage 34. The seals 68 engage and seal against the surface 70 and the latches 72, 74 cooperate to secure the wiper plug 60 to the cement retainer 10. As soon as the wiper plug 60 latches into the cement retainer 10, subsequent operations may commence, in contrast to the conventional squeeze operation where cement inside a work string and inside the conventional cement retainer has to be displaced in order to retrieve the conventional cement retainer after the cement has set up and the work string has to be retrieved from the well before subsequent operations can commence. Thus, in the practice of the disclosed technique, a subsequent set of perforations can be created and a subsequent squeeze operation initiated without delay.

With a slight modification, as by providing a threaded section inside the mandrel passage to latch onto a wiper plug, the cement retainer 10 may be very similar to the ball drop plug shown in application Ser. No. 12/317,497, filed Dec. 23, 2008, the disclosure of which is incorporated herein by reference.

Figure 4:
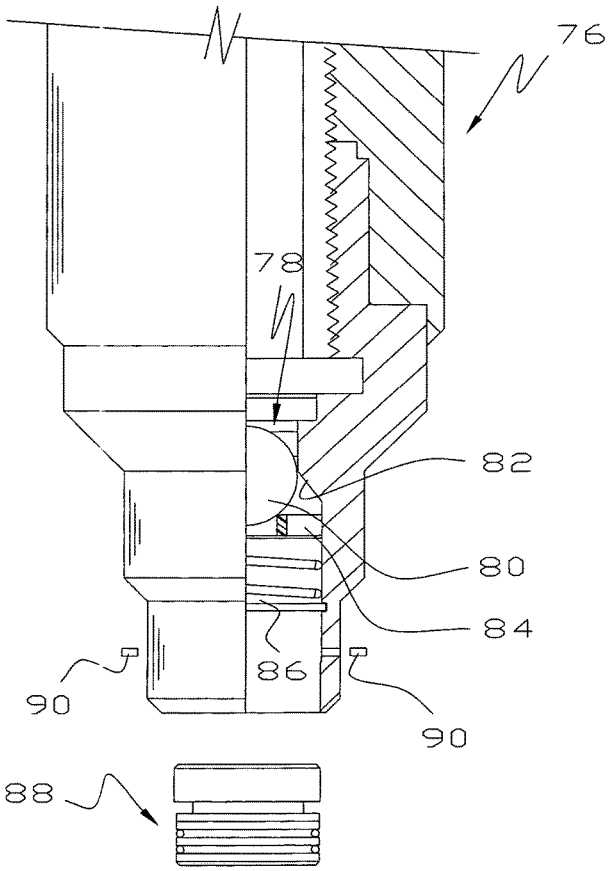
FIG. 4 is a cross-sectional view of an end of a modified cement retainer illustrating a check valve.

Referring to FIG. 4, there is illustrated a modified cement retainer 76 having a check valve 78 preventing upward flow in the cement retainer 76. The check valve 78 provides a redundant component keeping cement from flowing back into the casing 10 and also allows testing of the cement retainer after it has been set. To this end, the check valve 78 may provide a ball check 80 and a valve seat 82 preventing upward flow in the retainer 76 and an follower 84 biased upwardly by a spring 86 accommodating downward movement of the ball check 80. A pressure responsive plug 88 may be secured to the lower end of the tool 76 by pins 90 and be of a type that fails at a predetermined pressure. The casing 12 above the cement retainer 76 and the seal 48 can be tested by pumping into the cement retainer 76 until the pressure plug 88 fails, either by shearing the pins 90, rupturing a disc in the plug 88 or in any other suitable manner.

Figure 5:
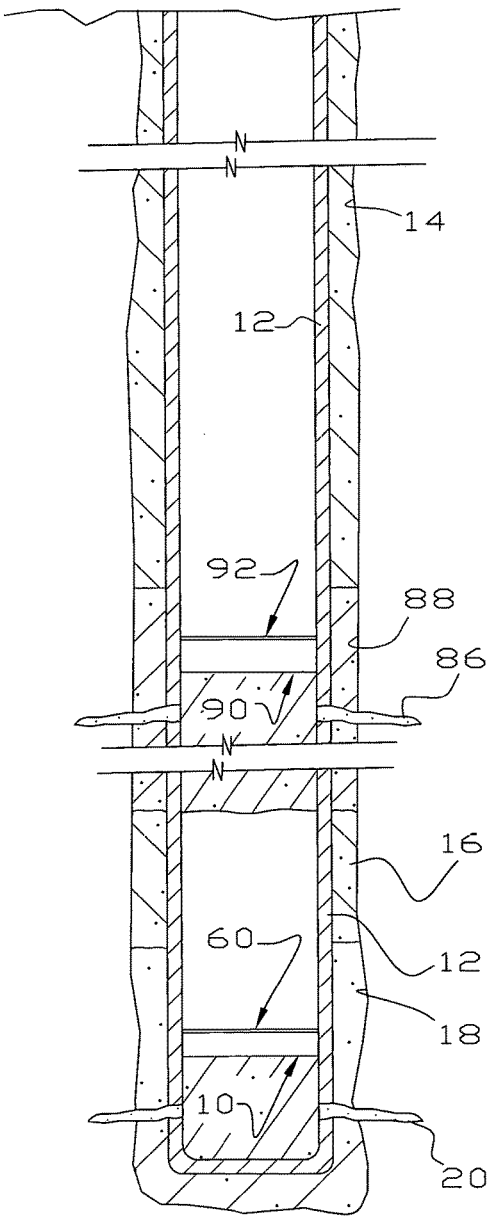
FIGS. 5 and 6 schematically illustrate conducting a series of squeeze jobs which are then drilled up in one bit trip.
Figure 6:
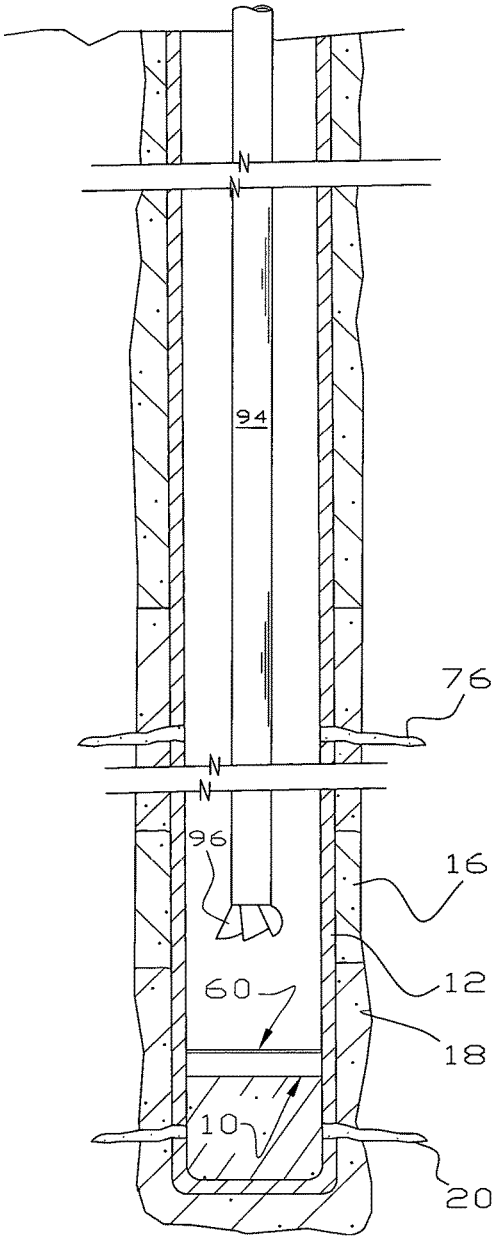

Referring to FIGS. 5-6, a series of squeeze jobs are illustrated in a situation where a primary cement job on the casing 12 is defective and a series of squeezes are necessary or desirable to obtain an adequate cement sheath on the outside of the casing 10. After squeezing cement into the gas pocket 18 as described above, a perforating assembly (not shown) is run into the casing and another set of perforations 86 created in the casing 10 nearer earth's surface in another area 88 of poor or non-existent cement. Another cement retainer 90 is run on wire line into the well and set adjacent the perforations 86. Cement is pumped into the casing 10 followed by another wiper plug 92. As many squeeze operations may be conducted, essentially one after another, until all the necessary or desirable repairs have been made to the cement sheath 16.

In situations where it is known that the wiper plugs and cement retainers will be drilled up, as in the situation illustrated in FIG. 5, they are made of drillable materials, such as composites, aluminum, brass, cast iron and the like, as is well known in the art. After allowing sufficient time for the last cement batch to set up, all of the wiper plugs and cement retainers may be drilled up by running a work string 94 having a bit or mill 96 thereon and drilling up all of the cement retainers and wiper plugs, which preferably may be done in one trip. The drilled up components of the cement retainers and wiper plugs are circulated out of the casing in a conventional manner leaving the interior of the casing 12 open past the perforations 20, 86. The work string 94 may be a conventional work string or coiled tubing. After drilling up all the cement retainers 10, 90, drilling of the well may continue by advancing the bit 96 past the bottom or distal end of the casing string 10.

Although FIGS. 5-6 illustrate a vertical well, the described squeeze operation may be conducted in the horizontal leg of a well.

It is also apparent that the cement retainer and technique disclosed herein may be used to squeeze existing perforations, as when it is necessary or desirable to blank off a producing interval or to reshoot a productive formation.

There are some situations where it is desirable to make cement retainers of materials other than composites. When the cement retainer 10 is used to plug wells in the process of abandoning them, the materials are typically drillable or non-drillable metals, such as steel or aluminum, with rubber or rubber-like seals. In plugging hydrocarbon wells, the cement retainer 10 can be lowered on wireline into a vertical well or pumped into a horizontal well and set against the casing string. A batch of cement can be pumped into the well followed by the plug 60. After a sufficient number of cement retainers 10, cement batches and plugs 60 are placed in the well, the casing 12 can be cut off below ground level, typically below plow depth, and a plate welded to the open end of the casing in order to abandon the well. In plugging situations, regulatory agencies may not allow the use of composite materials because of their unknown useful life. Thus, the cement retainer 10 may be made of drillable or non-drillable metals or other materials of long known useful life.

Although this invention has been disclosed and described in its preferred forms with a certain degree of particularity, it is understood that the present disclosure of the preferred forms is only by way of example and that numerous changes in the details of operation and in the combination and arrangement of parts can be resorted to without departing from the spirit and scope of the invention as hereinafter claimed.

I claim:

1. A cement retainer comprising a plug configured to be set at any of a series of locations inside a pipe string remote from a distal end of the pipe string, the plug including a body comprising a lowermost end and an uppermost end joined to the lowermost end and having a passage allowing flow therethrough, until sealed by a wiper plug, from adjacent the uppermost end through the lowermost end into the pipe string, and an expandable first seal, a first set of slips on one side of the first seal, a second set of slips on an opposite side of the first seal, a first expander on an exterior of the body for expanding the first slips and first seal and a second expander on the exterior of the body for expanding the second slips and first seal and thereby gripping an interior of the pipe string and setting the plug at any of the series of locations and sealing against the pipe string interior, the slips having a first exterior cross-sectional area, the slips, seal and expanders being of drillable materials, the body having a long axis extending through the uppermost and lowermost ends, the lowermost end having a terminus inclined to the long axis of the body, and a wiper plug being configured to latch onto the body preventing back flow of cement through the passage from below the lowermost end and having an exterior second seal adapted to wipe the pipe string interior during movement therethrough, the wiper plug exterior second seal having a second exterior cross-sectional area at least as large as the first cross-sectional area of the slips, the wiper plug being configured to latch onto the body with the second seal above the slips, above the first seal and above the uppermost body end, the wiper plug being drillable.

2. The cement retainer of claim 1 wherein the wiper plug is a dart having a first outer diameter having the exterior second seal thereon and a second outer diameter, less than the first outer diameter, having a latch thereon secured to an interior of the passage.

3. The cement retainer of claim 1 wherein the passage is unobstructed throughout its length except for the wiper plug.

4. The cement retainer of claim 1 further comprising a check valve preventing flow through the passage from the lowermost end toward the uppermost end.

5. The cement retainer of claim 1 wherein the wiper plug is latched inside the passage.

6. The cement retainer of claim 1 wherein the body passage includes a sealing surface at a location between a bottom of the expandable first seal and the uppermost body end, the wiper plug including a third seal configured to sealably engage the sealing surface between the bottom of the expandable first seal and the uppermost body end and thereby prevent flow through the body when the wiper plug is latched to the body.

7. A method of squeezing casing comprising:

cementing a string of casing in a well bore of a subterranean well and then creating perforations through the casing into an earth formation intersecting the casing thereby providing communication between the earth formation and an interior of the casing; then conducting squeeze operations to seal off the perforations including running a cement retainer, having a passage therethrough open to allow flow into the well, on a wire line into the casing and setting the cement retainer above a lower end of the casing string and above the perforations through the casing;

sealing between the cement retainer and the casing by a first expandable seal on an exterior of the cement retainer;

pumping cement through the perforations and through the casing into juxtaposition with the earth formation by pumping cement into the casing followed by a wiper plug having a second seal, larger than an exterior diameter of the cement retainer, wiping an interior of the casing, the wiper plug having a first outer diameter approximating an internal diameter of the casing, the wiper plug diameter being larger than the passage so the wiper plug cannot pass through the passage; and latching the wiper plug onto the cement retainer leaving a substantial portion of the wiper plug including the second seal above the expandable seal and sealing the passage thereby preventing back flow of cement into the casing.

8. The method of claim 7 wherein the wiper plug includes a first section of the first outer diameter having a second seal wiping the interior of the casing and a second section having a second outer diameter, smaller than the first outer diameter, having a third seal and the latching step comprises passing the second wiper plug section into the passage of the cement retainer and latching the second section of the wiper plug inside the passage and positioning the first section of the wiper plug above the first expandable seal.

9. The method of claim 7 further comprising drilling out the cement retainer and providing a passage through the casing past the perforations.

10. The method of claim 7 wherein the passage is filled with cement when the wiper plug latches onto the cement retainer.

11. The method of claim 7 further comprising creating second perforations through the casing nearer earth's surface than the first mentioned set of perforations, the second perforations communicating between a second earth formation and an interior of the casing; and then running a second cement retainer having a second body, slips, seal and expander and conducting a second squeeze operation including repeating the running, sealing and pumping steps with the second cement retainer, passing a second wiper plug into the casing and latching a second wiper plug to the second cement retainer at a location nearer earth's surface than the second perforations; and then drilling up all of the cement retainers and wiper plugs.

12. The method of claim 11 wherein the drilling step comprises drilling up all of the cement retainers and wiper plugs in one run of a cutting implement.

13. A method of squeezing casing cemented in a well bore of a hydrocarbon well, the cemented casing having perforations therethrough into an earth formation intersecting the casing, comprising:

a) providing a cement retainer, having a passage therethrough open to allow flow into a well, an expandable first seal, slips and at least one expander surrounding the body, running the cement retainer into the casing and setting the cement retainer above the perforations, expanding the slips and first seal and thereby gripping a smooth portion of an interior of the casing and sealing between an exterior of the cement retainer and the casing interior;

b) pumping cement into the casing followed by a wiper plug having a second seal wiping an interior of the casing;

c) passing cement through the passage and through the perforations into juxtaposition with the earth formation; and d) latching the wiper plug into the cement retainer and leaving the second seal above the expandable seal and above an uppermost end of the cement retainer.

14. The method of claim 13 further comprising running a work string having a cutting implement thereon and drilling out the cement retainer in one trip of the work string.

15. The method of claim 13 further comprising drilling beyond the distal end of the casing.

16. The method of claim 13 further comprising creating second perforations in the casing at a location nearer earth's surface than the first perforations, repeating steps a)-c) with a second cement retainer and second wiper plug and further comprising running a work string having a cutting implement thereon and drilling out all the cement retainers and wiper plugs in one trip of the work string.

17. The method of claim 13 wherein the cement retainer is run into the well on a wire line.

18. A method of squeezing casing in a well having a string of casing cemented in a well bore, the casing having perforations therethrough into an earth formation intersecting the casing, the method comprising:

conducting squeeze operations to seal off the perforations including running a cement retainer, having a passage therethrough, into the casing and setting the cement retainer above a lower end of the casing string and above the perforations through the casing;

sealing between the cement retainer and the casing by a first expandable seal on an exterior of the cement retainer;

pumping cement through the perforations and through the casing into juxtaposition with the earth formation by pumping cement into the casing followed by a wiper plug having a second seal, larger than an exterior diameter of the cement retainer, wiping an interior of the casing, the wiper plug having a first outer diameter approximating an internal diameter of the casing, the wiper plug diameter being larger than the passage so the wiper plug cannot pass through the passage;

latching the wiper plug onto the cement retainer leaving a substantial portion of the wiper plug above the cement retainer; and preventing back flow of cement upwardly through the passage.

* * * * *